US006772778B2

(12) United States Patent
Morosini et al.

(10) Patent No.: US 6,772,778 B2
(45) Date of Patent: Aug. 10, 2004

(54) HIKING STICK AND METHOD OF USING THE SAME

(75) Inventors: Rik M. Morosini, 675 Hampshire Rd. #28, Westlake Village, CA (US) 91361; Robert Fenzke, Newbury Park, CA (US)

(73) Assignee: Rik M. Morosini, San Diego, CA (US)

( * ) Notice: Subject to any disclaimer, the term of this patent is extended or adjusted under 35 U.S.C. 154(b) by 136 days.

(21) Appl. No.: 10/261,774

(22) Filed: Oct. 1, 2002

(65) Prior Publication Data

US 2004/0060587 A1 Apr. 1, 2004

(51) Int. Cl.[7] ..... A45B 3/00; A45B 3/02; A45B 3/10; A45B 3/14

(52) U.S. Cl. ..... 135/65; 135/66; 135/910; 362/102; 280/816; 280/819

(58) Field of Search ..... 135/65, 66, 910; 362/102; 280/816, 819

(56) References Cited

U.S. PATENT DOCUMENTS

| | | | | | |
|---|---|---|---|---|---|
| 1,509,157 | A | * | 9/1924 | Prudencio | 135/66 |
| 1,560,482 | A | | 11/1925 | Noisom | |
| 2,198,082 | A | * | 4/1940 | Harty | 359/516 |
| 2,210,493 | A | | 8/1940 | Lisi | 135/7 |
| 4,111,444 | A | * | 9/1978 | Clements, Jr. | 280/816 |
| 4,407,318 | A | * | 10/1983 | Stuever | 135/66 |
| D286,271 | S | * | 10/1986 | Buch | D10/102 |
| 4,762,340 | A | * | 8/1988 | Addison, Jr. | 280/816 |
| 4,832,362 | A | | 5/1989 | Chen | 280/645 |
| 4,858,125 | A | * | 8/1989 | Washizuka et al. | 600/301 |
| D307,665 | S | * | 5/1990 | Pressley | D3/6 |
| D324,945 | S | | 3/1992 | Pina | D3/9 |
| 5,097,856 | A | * | 3/1992 | Chi-Sheng | 135/72 |
| D325,297 | S | * | 4/1992 | Lipscomb | |
| 5,197,501 | A | * | 3/1993 | Ragatz | 135/66 |
| 5,303,954 | A | * | 4/1994 | Suda | 280/819 |
| 5,482,071 | A | * | 1/1996 | Liu | 135/66 |
| 5,567,115 | A | * | 10/1996 | Eckert et al. | 362/198 |
| 5,577,827 | A | * | 11/1996 | Leffingwell et al. | 362/109 |
| 5,588,735 | A | | 12/1996 | Harada | 362/102 |
| 5,722,445 | A | * | 3/1998 | Hae et al. | 135/65 |
| 5,749,644 | A | * | 5/1998 | Carbone | 362/198 |
| 6,004,004 | A | * | 12/1999 | Altman et al. | 362/191 |
| 6,012,824 | A | * | 1/2000 | Sharrah et al. | 362/199 |
| 6,283,610 | B1 | * | 9/2001 | Alajajian | 362/199 |
| 6,711,772 | B2 | * | 3/2004 | Grassi | 7/158 |

FOREIGN PATENT DOCUMENTS

| | | | | |
|---|---|---|---|---|
| GB | 2163958 | * | 3/1986 | A61H/3/02 |
| WO | WO 98/10845 | | 3/1998 | |

* cited by examiner

*Primary Examiner*—Robert Canfield
(74) *Attorney, Agent, or Firm*—Stephen C. Beuerle

(57) ABSTRACT

A multi-functional walking stick that holds a variety of useful and safety-enhancing tools and devices in an efficient manner that eliminates the need to separately carry similar tools and devices on one's body when walking, hiking, traversing, climbing, and the like.

20 Claims, 2 Drawing Sheets

HIKING STICK AND METHOD OF USING THE SAME

FIELD OF THE INVENTION

The present invention is, in general, in the field of walking sticks, and, in particular, in the field of multi-functional walking sticks.

BACKGROUND OF THE INVENTION

Walking sticks are used to help stabilize walkers when walking, hiking, traversing, climbing, and the like. A problem with walking sticks is that, minus a few exceptions, they have generally only been used to help stabilize walkers and not for other purposes. For example, U.S. Pat. No. 2,210,493 describes a multi-functional walking stick that includes an attached bag to carry items. A problem with this walking stick is that the accompanying bag is large, clumsy, obstructive and limited in its usefulness. U.S. Pat. No. 5,588,735 describes a multi-functional walking stick that includes an integrated flashlight for illuminating a road or path when walking at night. This walking stick is also limited in its usefulness. If a hiker wants to use the walking stick of U.S. Pat. No. 5,588,735 for a hike of any significant duration and length, the hiker would have to separately carry all the requisite items for the hike on his or her body separately. These problems and others are addressed by the walking stick and method of use of the present invention.

SUMMARY OF THE INVENTION

The present invention involves a multi-functional walking stick that holds a variety of useful and safety-enhancing tools and devices in an efficient manner that eliminates the need to separately carry similar tools and devices on one's body when walking, hiking, traversing, climbing, and the like.

Another aspect of the invention involves a multi-functional walking stick including an elongated, generally cylindrical shaft having a bottom, a bottom portion, a middle portion, a top, and a top portion having a threaded interior. A flashlight is detachably connected to the top of the elongated, generally cylindrical shaft. The flashlight includes a bendable base having a threaded exterior. The bendable base is threadingly engaged to the threaded interior of the elongated, generally cylindrical shaft. A flashlight head is rotatably connected to the bendable base. The flashlight head includes a housing, a detachable annular cover, and a novelty lens secured to the housing with the detachable annular cover. A compass unit is carried by the elongated, generally cylindrical shaft. A clock unit is carried by the elongated, generally cylindrical shaft. A hand grip circumferentially surrounds the elongated, generally cylindrical shaft. Multiple peg holes are vertically spaced along the elongated, generally cylindrical shaft. Multiple detachable devices each include at least one flexible connector peg to detachably connect the multiple detachable devices to the elongated, generally cylindrical shaft via the multiple peg holes. A cap is fixed to the bottom of the elongated, generally cylindrical shaft. The cap includes a tapered-outward bottom with a textured, friction, no-slip underside.

A further aspect of the invention involves a method of using a multi-functional walking stick. The method includes the steps of providing a multi-functional walking stick including an elongated, generally cylindrical shaft having a bottom, a bottom portion, a middle portion, a top, and a top portion having a threaded interior; a flashlight detachably connected to the top of the elongated, generally cylindrical shaft, the flashlight including a bendable base having a threaded exterior, the bendable base threadingly engaged to the threaded interior of the elongated, generally cylindrical shaft, a flashlight head rotatably connected to the bendable base, the flashlight head including a housing, a detachable annular cover, and a novelty lens secured to the housing with the detachable annular cover; a compass unit carried by the elongated, generally cylindrical shaft; a clock unit carried by the elongated, generally cylindrical shaft; a hand grip circumferentially surrounding the elongated, generally cylindrical shaft; multiple pegs holes vertically spaced along the elongated, generally cylindrical shaft; multiple detachable devices each including at least one flexible connector peg to detachably connect the multiple detachable devices to the elongated, generally cylindrical shaft via the multiple pegs holes; and a cap fixed to the bottom of the elongated, generally cylindrical shaft, the cap including a tapered-outward bottom with a textured, friction, no-slip, underside; detaching the annular cover from the housing of the flashlight head; replacing the novelty lens with a different interchangeable novelty lens; and attaching the annular cover to the housing of the flashlight head so that the different interchangeable novelty lens is secured to the housing of the flashlight head.

Further objects and advantages will be apparent to those skilled in the art after a review of the drawings and the detailed description of the preferred embodiments set forth below.

DETAILED DESCRIPTION OF PREFERRED EMBODIMENTS

Figure 1:
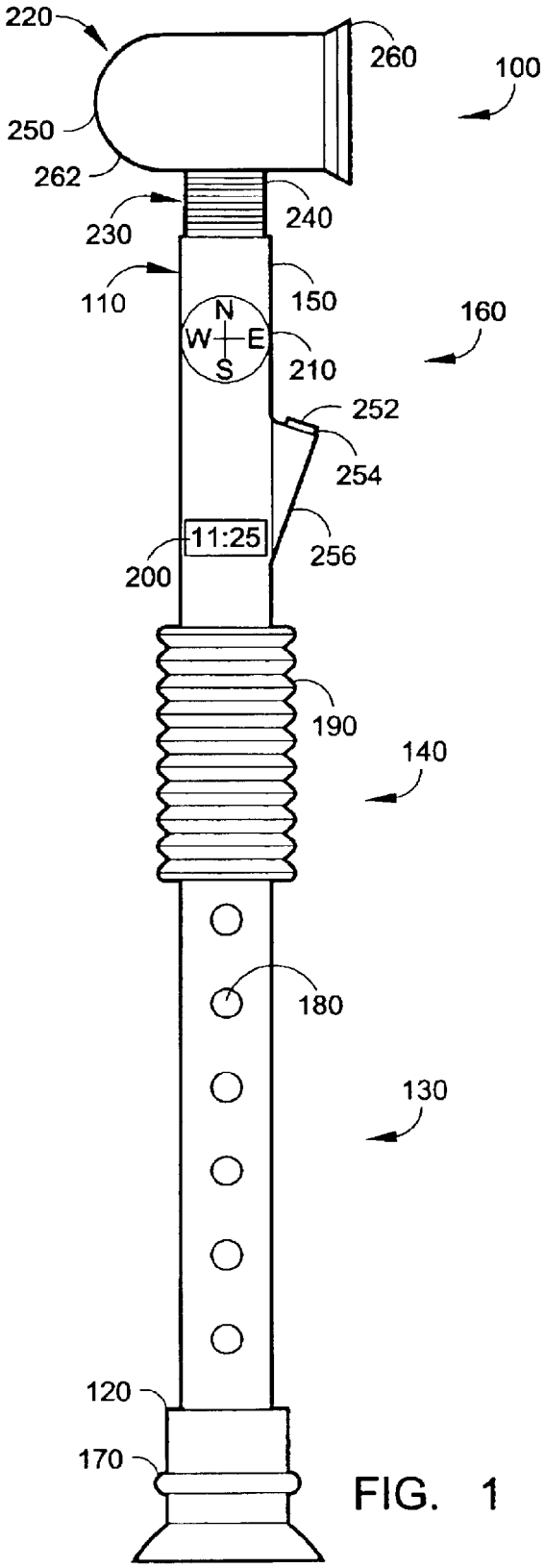
FIG. 1 is a side-elevational view of an embodiment of the walking stick of the present invention.

With reference to FIG. 1, an embodiment of a multi-functional walking stick 100 that holds a variety of useful and safety-enhancing detachable tools and devices will now be described. As used herein, the words "detached", "detachable" or "detachably" mean capable of being detached from and attached to.

The walking stick 100 includes an elongated, generally cylindrical shaft 110. The shaft 110 is preferably made of a light-weight material such as plastic, polyurethane, or fiber resin. The shaft 110 preferably has a density less than that of water so that the walking stick 100 will float in water for easy retrieval. The shaft 110 includes a strength to resist breakage under pressure up to 400 lbs, and is slightly flexible. The shaft 110 may have a wood veneer. Designer versions of the shaft 110 may have one or more of the following wood veneers: oak, pine, walnut, redwood, and cherry. The shaft 110 may come in a variety of colors and/or patterns that might include one or more of fluorescents, stripes, spots, psychedelics, gloss black, gold, silver, bronze, chrome, and metal flake. In an exemplary embodiment of the walking stick 100, the shaft 110 may have a length of 6.5 ft. and a diameter ranging from 2 to 2.5 inches. The walking stick 100 may come in different sizes (e.g., adult size, children size).

The elongated, generally cylindrical shaft 110 includes a bottom 120, a bottom portion 130, a middle portion 140, a top 150, and a top portion 160.

A rubber cap 170 may be fixed to bottom 120 of the shaft 110. The rubber cap 170 may have a generally cylindrical configuration with a diameter slightly greater than the diameter of the shaft 110. The cap 170 may taper outward near its bottom to form a large support surface for the walking stick 100. The bottom of the cap 170 may include a textured, friction, non-slip surface to prevent the bottom of the walking stick 100 from slipping on a support surface during use. The rubber cap 170 has a density greater than the density of water so that it easily submerges in water to facilitate footing through water.

The shaft 110 may include multiple peg holes 180 spaced evenly in a vertical manner along the shaft 110. The peg holes 180 form bores that extend transversely completely through the shaft 110. The bores are perpendicular to the longitudinal direction of the shaft 110. The peg holes 180 may receive flexible connector pegs of a variety of detachable tools and devices for detachably connecting the tools and devices to the shaft 110. Some of the tools and devices that may be detachably connected to the shaft 110 will be described in more detail below.

A foam hand grip 190 may be disposed around the circumference of the shaft 110 near the middle portion 140 of the shaft 110 to provide a secure and comfortable grasping area for the walking stick 100. The foam hand grip 190 may have circular pleats along its length to form a more secure grasping area. The foam hand grip 190 has a diameter slightly larger than the diameter of the shaft 110 and a length long enough to accommodate a user's entire hand (e.g., 4–8 inches).

A water-resistant clock unit 200 may be detachably connected (e.g., snap-fit) to the shaft 110 or integral with the shaft 110 for determining the time, duration of travel, or the like. In an embodiment where the clock unit 200 is detachably connected to the shaft 110, the shaft 110 may include a snap-close lid to protect the clock unit 200 from the environment. To change the battery in the clock unit 200, the clock unit 200 may be detached from the shaft 110 to access the battery compartment in the clock unit 200. In an embodiment where the clock unit 200 is integrated with the shaft 110, the shaft 110 may include an access door for the battery compartment for replacing the battery.

Similarly, a water-resistant compass unit 210 may be detachably connected (e.g., snap-fit) to the shaft 110 or integral with the shaft 110 for determining the direction of travel.

A flashlight 220 may be attached to the top 150 of the shaft 110. Near the top of the shaft 110, the shaft 110 may have a threaded interior that threadably receives a threaded base 230 of the flashlight 220. An upper portion 240 of the base 230 may be flexible and bendable for bending the flashlight 220 in a desired direction and orientation (e.g., up, down). A flashlight head 250 may be rotatably connected to the base 230 for rotating the flashlight head 250 three-hundred-and-sixty degrees with respect to the base 230. Because the flashlight 220 may screw into and out of the top 150 of the shaft 110, the flashlight 220 may be detached for use separate from the walking stick 100 or to replace batteries in the flashlight 220. The flashlight head 250 may include an illumination device (e.g., one or more incandescent bulbs, fluorescent bulbs, LEDs). The flashlight head 250 or the base 230 may include a power source (e.g., one or more batteries, fuel cells) for powering the illumination device. A switch 252 for turning the flashlight 220 on or off may be located at a terminal end 254 of angled shaft member 256. In an alternative embodiment, the switch 252 may be carried by the flashlight head 250 or base 230.

The flashlight head 250 may include a detachable annular cover 260 threadably attached to a housing 262 of the flashlight head 250. The annular cover 260 may retain a clear lens to the housing 262.

Figure 2A:
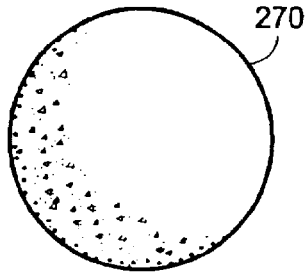
FIGS. 2A–2D are front-elevational views of different embodiments of interchangeable lenses that may be used with a flashlight of the walking stick illustrated in FIG. 1.
Figure 2B:
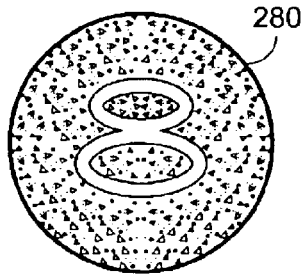
Figure 2C:
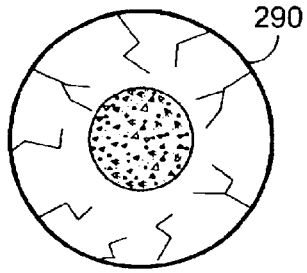
Figure 2D:
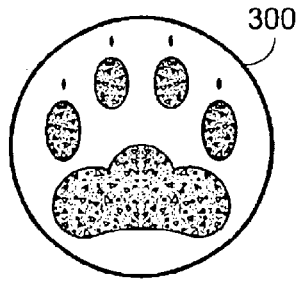

With reference additionally to FIGS. 2A–2D, the detachable cover 260 allows different interchangeable novelty lenses to be used in the flashlight head 250. FIG. 2A illustrates an embodiment of a crystal ball lens 270. FIG. 2B illustrates an embodiment of an eight-ball lens 280. FIG. 2C illustrates an embodiment of an eyeball lens 290. FIG. 2D illustrates an embodiment of a bear claw lens 300. Although four different novelty lenses 270, 280, 290, 300 are shown, other interchangeable novelty lenses may be used.

Figure 3A:
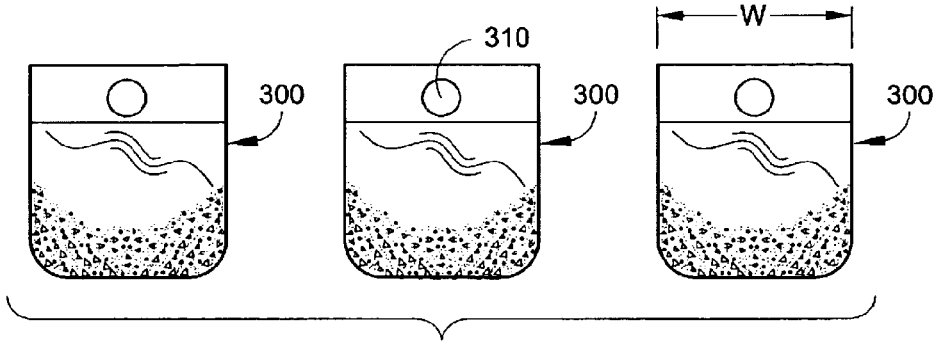
FIG. 3A is a front-elevational view of embodiments of multiple detachable storage pouches that may be detachably connected to the walking stick illustrated in FIG. 1.

With reference to FIG. 3A, multiple storage pouches 300 that may be detachably connected to the shaft 110 are shown. To prevent the storage pouches 300 from being large, clumsy, and obstructive as in U.S. Pat. No. 2,210,493, the storage pouches 300 preferably have a width W that is the same as or similar to the width or diameter of the shaft 110. As used herein, a similar width is a width that is in the range of 0.5 to 1.5 the width or diameter of the shaft 110. The storage pouches 300 may include transversely extending flexible connector pegs 310 that are received by the peg holes 180 for detachably connecting the storage pouches 300 to the shaft 110. Although three storage pouches 300 are shown, the number of storage pouches 300 used with the walking stick 100 may vary (i.e., 0, 1, 2, 3, etc.).

Figure 3B:
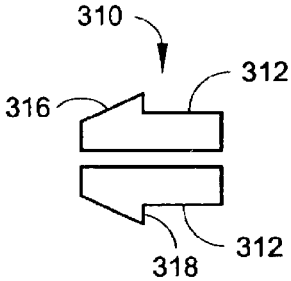
FIG. 3B is a side-elevational view of an embodiment of a flexible connector peg that may be used for detachably connecting the tools and devices to the walking stick illustrated in FIG. 1.

With reference to FIG. 3B, an embodiment of the flexible connector peg 310 that may be used for detachably connecting the tools and devices to the walking stick 100 will now be described in more detail. The flexible connector peg 310 may include a pair of spaced, parallel, flexible arms 312. The arms 314 terminate in opposite catch members 316. The catch members 316 include semi-circular ledges 318.

Figure 3C:
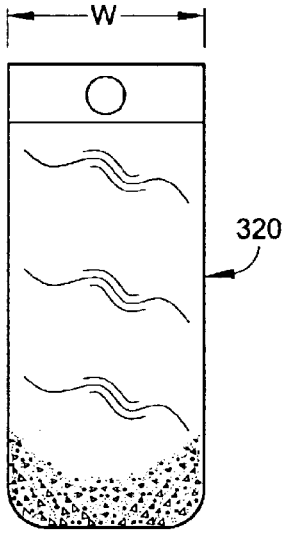
FIG. 3C is a front-elevational view of an embodiment of a cellular phone carrier that may be detachably connected to the walking stick illustrated in FIG. 1.
Figure 4:
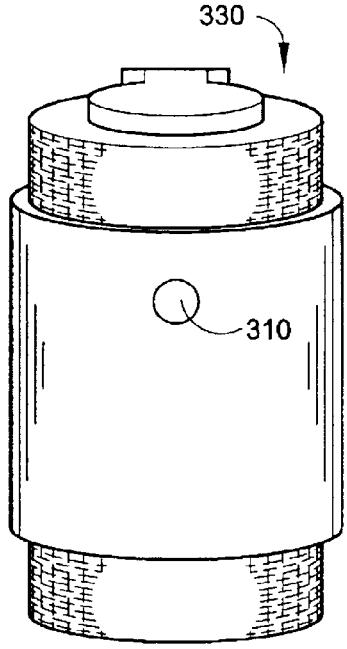
FIG. 4 is a front-elevational view of an embodiment of a water bottle that may be detachably connected to the walking stick illustrated in FIG. 1.
Figure 5:
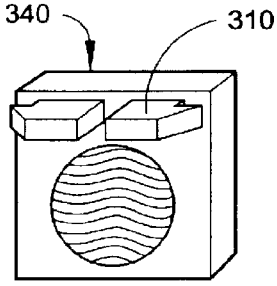
FIG. 5 is a front-elevational view of an embodiment of a radio transmiter that may be detachably connected to the walking stick illustrated in FIG. 1.
Figure 6:
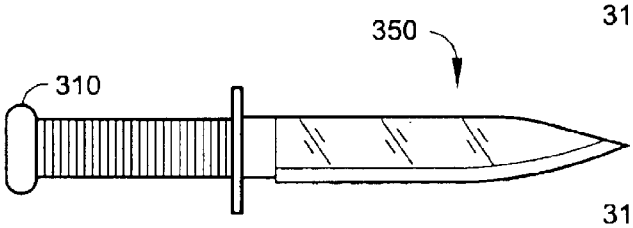
FIG. 6 is a front-elevational view of an embodiment of a survival knife that may be detachably connected to the walking stick illustrated in FIG. 1.
Figure 7:
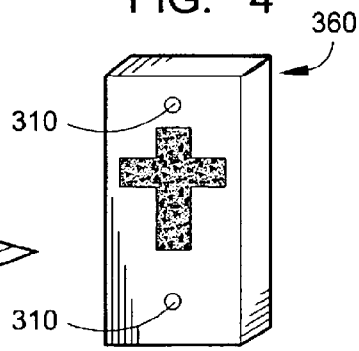
FIG. 7 is a front-elevational view of an embodiment of a first-aid kit that may be detachably connected to the walking stick illustrated in FIG. 1.

With reference to FIG. 3C, an embodiment of a cellular phone carrier 320 is shown. The cellular phone carrier 320 is used for storing and transporting a cellular phone. Although the carrier 320 is described as being used to store and transport a cellular phone, the carrier 320 may be used to store and transport other handheld computing devices such as, but not by way of limitation, a GPS system, a pager, or a PDA. Further, more than one carrier 320 may be used for storing and transporting more than one handheld computing device. The cellular phone carrier 320 includes a transversely extending flexible connector peg 310 that is received by a peg hole 180 for detachably connecting the cellular phone carrier 320 to the shaft 110. To prevent the carrier 320 from being large, clumsy, and obstructive, the carrier 320 preferably has a width W that is the same as or similar to the width or diameter of the shaft 110.

FIGS. 4, 5, 6, and 7 show embodiments of a water bottle 330, a waterproof radio transmitter 340, a survival knife 350, and a waterproof first-aid kit 360, respectively, which may be detachably attached to the shaft 110 via transversely extending flexible connector pegs 310 and peg holes 180. The first-aid kit 360 may include a pair of transversely extending flexible connector pegs 310 for removably attaching the first-aid kit 360 to the shaft 110 via a pair of corresponding peg holes 180. Similar to the first-aid kit 360, the other detachable tools and devices may include more than one flexible connector peg 310 for attaching the tools and devices to the shaft 110 at more than one attachment point. Attaching the tools and devices to the shaft 110 at more than one attachment point further secures attachment of the tools and devices to the shaft 110.

The walking stick 110 will now be described in use. During normal use, the walking stick 110 may be handled by grasping the walking stick 110 at the foam hand grip 190. As a user walks with the walking stick 110, the bottom of the rubber cap 170 is placed on the walking surface. The tapered cap 170 forms a large support surface for the walking stick 100 and the textured, friction, non-slip surface on the bottom of the cap 170 helps prevent the walking stick 100 from slipping on a walking surface during use. Because rubber cap 170 has a density greater than the density of water, it easily submerges in water to facilitate footing through water when traversing streams or the like. The clock unit 200 may be used to determine the current time or to record a duration of a walk. The compass unit 210 may be used to determine direction of travel for orienteering or the like. In insufficient-light conditions (e.g., night), the attached flashlight 220 may be used to illuminate the area in front of the user while walking with the walking stick 100. The flashlight 220 also serves the dual purpose of alerting others of the walker's presence. The orientation of the flashlight 220 may be adjusted by bending the base 230 to the desired configuration and/or rotating the flashlight head 250 relative to the base 230. The flashlight 220 is easily removed from the top 150 of the walking stick 100 by unscrewing the base 230 from the top 150 of the shaft 110. The base 230 of the flashlight 220 may then be used as a handle for carrying the flashlight 220 separate from the walking stick 100. To attach the flashlight 220 to the walking stick 100, the base 230 is screwed into the interior threaded top portion 160 of the shaft 110. Different interchangeable novelty lenses (FIGS. 2A–2D) may be added to the flashlight 220 by unscrewing the annular cover 260 from the housing 262, removing the existing lens, and replacing it with a different novelty lens 270, 280, 290, 300. To secure a storage pouch 300 to the walking stick 100, the flexible connector peg 310 is inserted through a selected peg hole 180. As the flexible connector peg 310 is inserted into a selected peg hole 180, the flexible catch members 316 and arms 312 are urged together by the inner wall of the hole 180. When the flexible connector peg 310 is inserted completely through the hole 180, so that the flexible catch members 316 are no longer urged towards each other, the flexible catch members 316 flex outwards so that the semi-circular ledges 318 catch on the side of the shaft 110, around the hole 180. To detach the storage pouch 300 from the walking stick 100, the flexible catch members 316 of the flexible connector peg 310 are pinched inwards by the user so that the semi-circular ledges 318 no longer catch on the side of the shaft 110 around the hole 180, and the flexible connector peg 310 is pulled out of the hole 180 by pulling laterally outward on the storage pouch 300. The other detachable tools and devices 320, 330, 340, 350, 360 are added to and detached from the walking stick 100 in a similar manner.

Thus, the multi-functional walking stick of the present invention holds a variety of useful and safety-enhancing tools and devices in an efficient manner that eliminates the need to separately carry similar tools and devices on one's body when walking, hiking, traversing, climbing, and the like.

It will be readily apparent to those skilled in the art that still further changes and modifications in the actual concepts described herein can readily be made without departing from the spirit and scope of the invention as defined by the following claims.

What is claimed is:

1. A multi-functional walking stick, comprising:

an elongated, generally cylindrical shaft including a bottom, a bottom portion, a middle portion, a top, and a top portion having a threaded interior;

a flashlight detachably connected to the top of the elongated, generally cylindrical shaft, the flashlight including a bendable base having a threaded exterior, the bendable base threadingly engaged to the threaded interior of the elongated, generally cylindrical shaft, a flashlight head rotatably connected to the bendable base, the flashlight head including a housing, a detachable annular cover, and a novelty lens secured to the housing with the detachable annular cover;

a compass unit carried by the elongated, generally cylindrical shaft;

a clock unit carried by the elongated, generally cylindrical shaft;

a hand grip circumferentially surrounding the elongated, generally cylindrical shaft;

multiple peg holes vertically spaced along the elongated, generally cylindrical shaft;

multiple detachable devices each including at least one flexible connector peg to detachably connect the multiple detachable devices to the elongated, generally cylindrical shaft via the multiple peg holes; and a cap fixed to the bottom of the elongated, generally cylindrical shaft, the cap including a tapered-outward bottom with a textured, friction, no-slip underside.

2. The multi-functional walking stick of claim 1, wherein one of the multiple detachable devices includes a storage pouch.

3. The multi-functional walking stick of claim 2, wherein the elongated, generally cylindrical shaft includes a width and the storage baguouch has a width the same as or similar to the width of the elongated, generally cylindrical shaft.

4. The multi-functional walking stick of claim 1, wherein one of the multiple detachable devices includes a cellular phone carrier.

5. The multi-functional walking stick of claim 1, wherein one of the multiple detachable devices includes a first-aid kit.

6. The multi-functional walking stick of claim 1, wherein one of the multiple detachable devices includes a water bottle.

7. The multi-functional walking stick of claim 1, wherein one of the multiple detachable devices includes a radio transmitter.

8. The multi-functional walking stick of claim 1, wherein one of the multiple detachable devices includes a survival knife.

9. The multi-functional walking stick of claim 1, wherein the flexible connector peg includes a pair of spaced, parallel, flexible arms that terminate in opposite catch members.

10. A method of using a multi-functional walking stick, comprising the steps of:

providing a multi-functional walking stick including an elongated, generally cylindrical shaft including a bottom, a bottom portion, a middle portion, a top, and a top portion having a threaded interior; a flashlight detachably connected to the top of the elongated, generally cylindrical shaft, the flashlight including a bendable base having a threaded exterior, the bendable base threadingly engaged to the threaded interior of the elongated, generally cylindrical shaft, a flashlight head rotatably connected to the bendable base, the flashlight head including a housing, a detachable annular cover, and a novelty lens secured to the housing with the detachable annular cover; a compass unit carried by the elongated, generally cylindrical shaft; a clock unit carried by the elongated, generally cylindrical shaft; a hand grip circumferentially surrounding the elongated, generally cylindrical shaft; multiple pegs holes vertically spaced along the elongated, generally cylindrical shaft; multiple detachable devices each including at least one flexible connector peg to detachably connect the multiple detachable devices to the elongated, generally cylindrical shaft via the multiple pegs holes; and a cap fixed to the bottom of the elongated, generally cylindrical shaft, the cap including a tapered-outward bottom with a textured, friction, no-slip underside;

detaching the annular cover from the housing of the flashlight head;

replacing the novelty lens with a different interchangeable novelty lens; and attaching the annular cover to the housing of the flashlight head so that the different interchangeable novelty lens is secured to the housing of the flashlight head.

11. The method of claim 10, further including orienting the flashlight by bending the bendable base and rotating the flashlight head relative to the bendable base.

12. The method of claim 10, further including unscrewing the bendable base of the flashlight from the top of the elongated, generally cylindrical shaft, and using the flashlight separate from the walking stick.

13. The method of claim 10, wherein one of the multiple detachable devices includes a storage pouch, and the method includes attaching the storage pouch to the elongated, generally cylindrical shaft and detaching the storage pouch from the elongated, generally cylindrical shaft.

14. The method of claim 13, wherein the elongated, generally cylindrical shaft includes a width and the storage bag pouch has a width the same as or similar to the width of the elongated, generally cylindrical shaft.

15. The method of claim 10, wherein one of the multiple detachable devices includes a cellular phone carrier, and the method includes attaching the cellular phone carrier to the elongated, generally cylindrical shaft and detaching the cellular phone carrier from the elongated, generally cylindrical shaft.

16. The method of claim 10, wherein one of the multiple detachable devices includes a first-aid kit, and the method includes attaching the first-aid kit to the elongated, generally cylindrical shaft and detaching the first-aid kit from the elongated, generally cylindrical shaft.

17. The method of claim 10, wherein one of the multiple detachable devices includes a water bottle, and the method includes attaching the water bottle to the elongated, generally cylindrical shaft and detaching the water bottle from the elongated, generally cylindrical shaft.

18. The method of claim 10, wherein one of the multiple detachable devices includes a radio transmitter, and the method includes attaching the radio transmitter to the elongated, generally cylindrical shaft and detaching the radio transmitter from the elongated, generally cylindrical shaft.

19. The method of claim 10, wherein one of the multiple detachable devices includes a survival knife, and the method includes attaching the survival knife to the elongated, generally cylindrical shaft and detaching the survival knife from the elongated, generally cylindrical shaft.

20. The method of claim 10, wherein the flexible connector peg includes a pair of spaced, parallel, flexible arms that terminate in opposite catch members, and the method includes attaching the detachable device to the elongated, generally cylindrical shaft by inserting the flexible connector peg through the peg hole so that the flexible catch members and arms are urged together during insertion into the hole and are flexed outward when the flexible connector peg clears the peg hole and detaching the detachable device from the elongated, generally cylindrical shaft includes pinching the flexible catch members inwards and pulling laterally outward on the detachable device.

* * * * *